US005271710A

United States Patent [19]

Decharran et al.

[11] Patent Number: 5,271,710

[45] Date of Patent: Dec. 21, 1993

[54] DEVICE FOR LOADING ARTICLES ONTO AN UNSTACKING MAGAZINE AND A LOADING METHOD USING THIS DEVICE

[75] Inventors: Dominique Decharran, Bourg Les Valence; Christian Laumond, Chabeuil, both of France

[73] Assignee: Compagnie Generale D'Automatisme, Bretigny-Sur-Orge, France

[21] Appl. No.: 722,830

[22] Filed: Jun. 28, 1991

[30] Foreign Application Priority Data

Jul. 2, 1990 [FR] France ..... 90 08339

[51] Int. Cl.[5] ..... A65G 57/00

[52] U.S. Cl. ..... 414/798.9; 414/421

[58] Field of Search ..... 414/798.9, 795.9, 421, 414/778, 770

[56] References Cited

U.S. PATENT DOCUMENTS 2,365,007 4/1942 Rideout et al. ..... 414/421

3,223,257 12/1965 Kinkopf ..... 414/421

FOREIGN PATENT DOCUMENTS 2249007 5/1975 France .

88/01543 3/1988 World Int. Prop. O. .

*Primary Examiner*—Joseph E. Valenza

*Assistant Examiner*—C. Wallace

*Attorney, Agent, or Firm*—Sughrue, Mion, Zinn, Macpeak & Seas

[57] ABSTRACT

The device essentially comprises a conveyor, on which bins for storing articles stacked flat are loaded, and a coupling deck between the conveyor and the magazine, the coupling deck being hinged about its end adjoining the magazine and having firstly a tipping trough for tipping over the bin coming off the conveyor about the leading bottom edge of the bin, and secondly lateral retaining fins for retaining the bin tipped over onto the deck while the deck is being tilted. The invention is applicable to installations for unstacking postal articles.

11 Claims, 1 Drawing Sheet

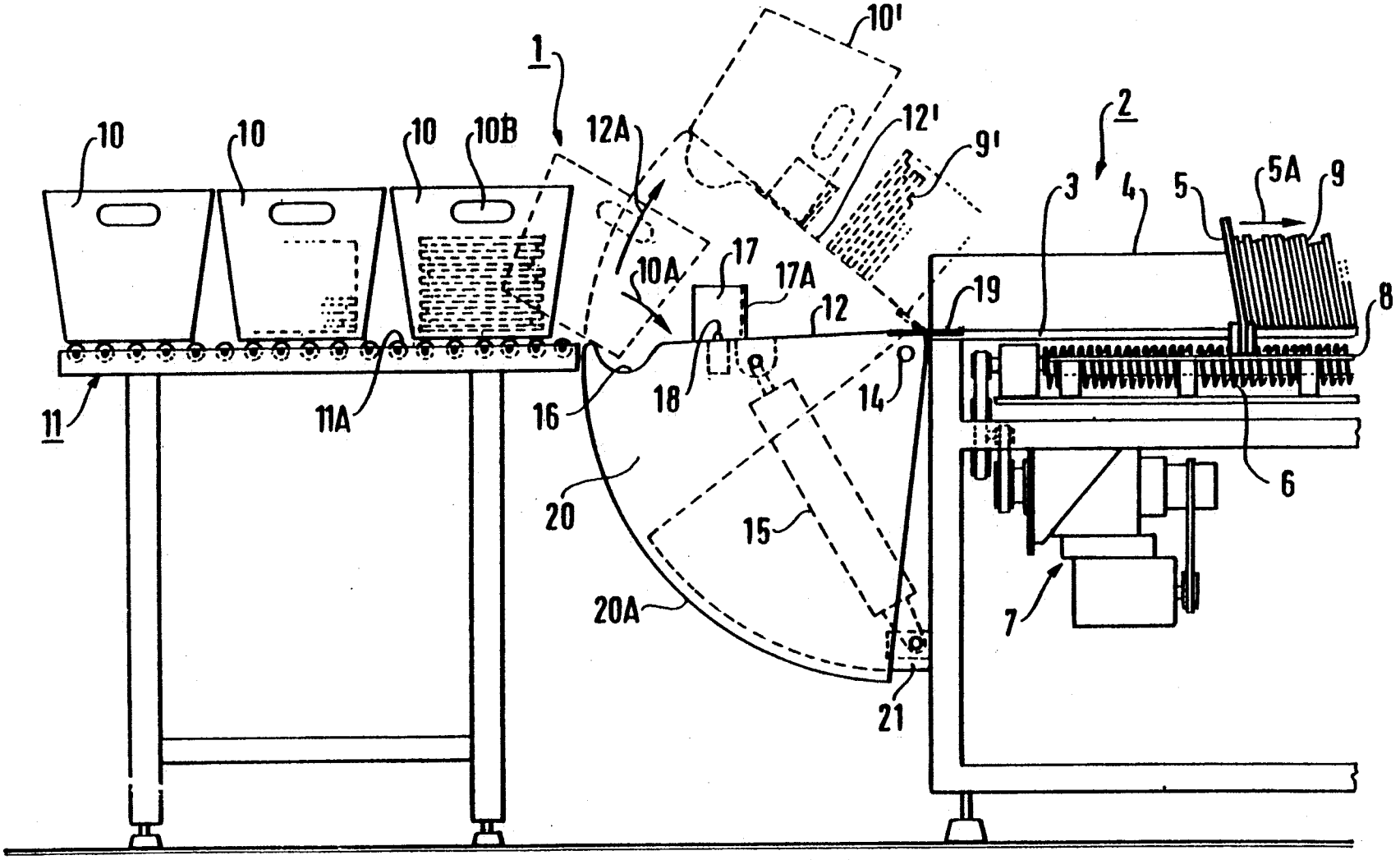
8
9
5A
5
6
2
4
3
7
19
9'
12'
10'
14
21
12
17A
17
15
18
10A
12A
1
16
20
20A
10B
10
11A
10
10
11

DEVICE FOR LOADING ARTICLES ONTO AN UNSTACKING MAGAZINE AND A LOADING METHOD USING THIS DEVICE

The present invention relates to loading unstacking magazines in installations for unstacking flat articles.

Such flat articles may be constituted in particular by postal items, such as letters of various possible formats, postcards, journals, etc.

BACKGROUND OF THE INVENTION

In this type of installation, the unstacking magazine is conventionally equipped with members for separating articles individually, said members being mounted at a front end of the magazine and being commonly referred to as an "unstacking head". The magazine is also equipped with retaining means for retaining the articles in one or more stacks, said retaining means being coupled to drive means to move the articles forwards along the magazine towards its head.

By way of example, the unstacking head may be of the type having a suction cup movably mounted to rock so as to come into contact with and take hold of the facing end article in the stack, and to reciprocate in translation so as to take the held article away from the magazine and release it, and then to return to the front of the stack. This head is adapted to the characteristics of the articles to enable them to be taken one-by-one without being damaged. Its positioning and/or its rocking may be controlled by detecting the format and/or disposition of the successive end articles to be removed.

The magazine feeds the head as and when articles are removed. The retaining means for retaining the articles are of the type having panels coupled to the drive means. When unstacking relatively uniform articles, these panels remain fixed to the drive means which are constituted by an endless conveyor or chain. The panels are driven in an active position from the rear of the magazine to its front, to move the articles forwards, and the panels are retracted in front of the head from where they are recycled in an inactive position back to the rear of the magazine. Instead of using such panels spread out in this way around a closed circuit, it is preferable to use removable panels on the magazine, in particular when the articles are very varied.

French Patent Application 89 13605 filed in the name of the Applicant describes such a magazine having removable panels. These panels are installed by hand and they are coupled to the drive means in a loading zone on the rear portion of the magazine, from where they move the articles loaded onto this zone forwards up to the head. They separate from the drive means in front of the head and are guided to and received in a panel storage zone provided on one side of the front end portion of the magazine.

In both of these types of magazine, and in particular in magazines having removable panels, the articles are loaded onto the rear zone of the magazine by hand. This hand loading of articles is not very convenient. It suffers from certain difficulties, especially when the articles are varied and relatively slippery, and/or when the preceding stack has already advanced a considerable distance along the magazine and is relatively far away from the supply of articles, which supply is generally in the form of a bin on a work surface at the rear end of the magazine. Among the difficulties and problems encountered, the following should be mentioned in particular:

it is difficult to keep the stack together between being removed from the supply and being deposited behind the panel retaining the previous stack and moving it forwards; and building up a new stack by removing small batches from the supply requires the batches that have already been loaded to be held substantially vertical with one hand, while further batches are being removed with the other hand.

Furthermore, such difficult manipulation is not very compatible with the time restrictions imposed on an operator in charge of feeding a plurality of magazines and checking that they are operating correctly.

The object of the present invention is to avoid these problems by loading the articles directly and quickly from storage bins onto the unstacking magazine, to facilitate the work of the operator, to improve the comfort and quality of the work, and to organize operator time better.

SUMMARY OF THE INVENTION

The invention provides a device for loading articles from storage bins in which the articles are stacked flat onto a "rear" end portion of an unstacking magazine, said device comprising a conveyor substantially level with but not adjoining the rear end portion of the magazine and receiving the bins of articles, and further comprising a substantially horizontal coupling deck between the conveyor and the rear end portion of the magazine, a first end of said coupling deck being hinged on a shaft to pivot substantially about the rear end of the magazine, said coupling deck having firstly, close to its opposite second end, a tipping trough for tipping the bins onto the deck, in which trough the leading bottom edge of the bin coming off the conveyor is engaged, and secondly, at a distance from the trough substantially equal to the height of the bins, a pair of lateral retaining fins for retaining the bin tipped onto the deck about its bottom edge.

The fins may have inwardly-directed flanges preventing the bin from sliding on the deck when tilted.

The device may further include an actuator for actuating the deck and controlled by detecting the presence of a bin tipped onto the deck.

The invention also provides a method of loading articles by this device, said method consisting in:

loading said bins filled with articles onto the conveyor;

ensuring that the end portion of the unstacking magazine is free of articles over a length not less than the height of an entire stack of articles in a bin; and under these conditions, moving a first bin on the conveyor forwards onto said deck, until the leading bottom edge of said first bin falls into said trough;

tipping the bin over onto the deck about its leading bottom edge engaged in the trough; and retaining the stack of articles in the tipped-over bin, while the deck tilts, guiding the stack while it slides by gravity out of the bin and along the tilted deck, and bringing the stack into position against the stack previously loaded on the magazine.

BRIEF DESCRIPTION OF THE DRAWING

An embodiment of the invention is described by way of example with reference to the sole figure of the accompanying drawing which is a diagrammatic elevation view of a device of the present invention for loading articles onto an unstacking magazine of which only a fragment is shown.

DETAILED DESCRIPTION

The device of the invention is given overall reference 1 in the figure; the unstacking magazine, or rather only its rear end portion as loaded by the device 1, is designated by overall reference 2.

This magazine lies outside the scope of the present invention. The magazine is of an existing type known per se and preferably the magazine described in the above-mentioned Application filed by the Applicant. A brief description of this magazine is included below.

The magazine includes a substantially horizontal platform 3 with a side wall 4 running along its far side. The magazine has panels 5 for retaining stacks of articles and moving them forwards along the platform, these panels being stood on end and leaning slightly backwards. Said panels 5 are coupled to drive means comprising a worm 6 rotated by a motor and stepdown gear box unit 7 having a brake-clutch. The unstacking magazine is further equipped with means for separating articles individually, these means constituting an "unstacking head" mounted at the front end portion of the magazine.

The panels are preferably removable and individually installed by the operator. To this end, each of them has a bottom finger inserted between the platform 3 and a bottom guide plate 8 extending under the near side edge of the platform, said finger meshing with the thread of the worm 6. When the panels have reached the end of their stroke along the platform and are in the front end portion thereof, they are detached from the worm and they are removed to a panel storing zone provided to one side of said front end portion. The panels are thus made available for being used as and when new stacks of articles are loaded onto the rear end portion of the magazine.

The arrow 5A represents the advance of a stack of articles 9 moved forwards along the magazine by the panel 5 at the back of this stack.

The device 1 of the invention loads a complete new stack directly onto the unstacking magazine 2. Said device is installed level with the platform 3 and is coupled to the rear end portion of the platform.

The device operates using bins 10 having handhold means 10B, which are constituted by slots in this case, but which could be handles. Each of these bins contains a stack of articles stacked flat, which stack is loaded as a whole onto the magazine 2.

This device includes a conveyor 11 for the bins 10 and a coupling deck 12 between the conveyor 11 and the platform 3, said coupling deck tipping out the contents of successive bins 10 onto the platform.

The conveyor 11 has free rollers 11A. The coupling deck 12 is substantially horizontal. The deck is hinged on a shaft 14 to pivot substantially about the rear end of the platform 3 of the magazine. The deck is tilted about this shaft 14 by an actuator 15, the deck thus being moved to a sloping position above the platform in order to transfer the contents of the bin carried by the deck onto the platform 3.

The coupling deck 12 is almost plane, except close to its end adjacent to the conveyor 11, where it has a rounded recess or tipping trough 16 for tipping the bin about its bottom edge which is engaged in said trough when the bin comes off the conveyor. The deck is equipped with two lateral fins 17, face to face and projecting above the deck. These fins are intended for centering and holding the bin between them when it is tipped onto the deck 12. The front edge 17A of each fin is situated at a distance from the trough 16 corresponding to the height of the bins, and it has a small inwardly directed flange for holding the bin without obstructing articles contained therein. Furthermore, the far fin on the deck may be extended or associated with a far wall (not shown) extending to the end of the deck that is coupled to the magazine, which extension is interrupted before reaching a lip 19 and in no way prevents the deck 12 from being tilted and the lip 19 from being deformed.

A contact 18 protruding slightly above the deck 12 detects the presence of a bin tipped onto the deck, thereby energizing the actuator 15 which tilts the deck carrying the bin. The distance from the trough to this contact is shorter than the height of the bins.

A flexible lip 19 fixed at one end on the deck 12 end which is coupled to the magazine overlies a margin of the platform 3 thereby preventing articles of stack 9' from dropping between deck 12 and the end of the magazine 2.

The deck 12 is also flanked by a lateral skirt 20 which extends thereunder on both sides.

This skirt is mounted on the hinge shaft 14 moves with the deck. The skirt has the shape of a sector of a circle occupying an angle of approximately 90°, this sector being delimited at one edge by the deck 12. The rounded edge 20A of the skirt enables the skirt to pass freely in front of the end of the conveyor 11. Each side of the moving skirt 20 overlies a sidewall 21 having the shape of part of the moving skirt, but remaining fixed against the end of the magazine, and referred to herein as the "fixed skirt". This fixed skirt serves to hide the tilting mechanism of the deck and cooperates with the moving skirt to provide protection.

Operation of the device is described below, 10A designating the arrow showing that a bin is tipped onto the deck, 10' designating the tipped bin as shown by dotted lines, 12A designating the arrow showing that the deck is tilted to raise the bin, and 12' designating the deck tilted into its high position.

The operator places a series of full bins 10 on the conveyor 11 thereby providing a supply of articles for loading. The operator monitors the overall installation to see that it is operating correctly, and in particular monitors the feed requirements of the unstacking magazine, so as to cause a new stack to be loaded behind the rearmost stack 9 and retaining panel 5 on the magazine 2. This loading may be effected as soon as the empty end portion is long enough to receive the entire stack contained in the first bin.

To load the magazine, the operator moves the first bin at the end of the conveyor forwards over the trough 16 in the deck by using the left hand and the handhold 10B. The leading bottom edge then falls into the trough, thereby beginning to tip over the bin. The operator causes this tipping motion to continue, still using the left hand to position the bin so that it lies on its side and is centered between the fins 17. The stack of articles, which were initially stacked flat and one on top of another, is now standing on end inside the tipped-over bin and is held back by the operator using the other hand.

Once the bin has been tipped over, it actuates the contact 18. The contact then causes the deck 12 to be tilted by the actuator 15 following the arrow 12A, to raise the bin 10' which is retained by the flanges 17A of the fins 17.

Once the bin has been raised in this way, the stack of articles (designated by 9') in the bin comes out of the bin, while being held up by the right hand of the operator, who guides the stack letting it slide by gravity along the deck 12' towards the platform 3. The operator can use both hands to guide the stack 9' onto the platform 3, one hand in front of the stack and one hand behind it, and can then move it up against the previously loaded stack 9 using the left hand only.

The newly-loaded stack is then retained by a new panel positioned behind it.

Advantageously, a retarder is associated with the actuator 15 to enable the deck to return automatically to its horizontal standby position. Once the deck has returned to its horizontal position, the operator removes the empty bin from the deck at a suitable moment.

The article loading device of the invention facilitates the work of the operator considerably and enables the stack contained in the bin to be kept together and loaded directly onto the magazine as a whole. The device enables the unstacking magazine to be loaded more quickly and the worktime of the operator to be better organized.

This invention is described above with reference to the embodiment shown in the drawing. Naturally, various details may be modified by a person skilled in the art, without going beyond the scope of the invention.

We claim:

1. A device for loading articles from storage bins in which the articles are stacked flat onto a "rear" end portion of an unstacking magazine, said device comprising a conveyor substantially level with but not adjoining the rear end portion of the magazine and receiving the bins of articles, and further comprising a substantially horizontal coupling deck between the conveyor and the rear end portion of the magazine, a first end of said coupling deck being hinged on a shaft to pivot substantially about the rear end of the magazine, said coupling deck having firstly, close to its opposite second end, a tipping trough for tipping the bins onto the deck, in which trough the leading bottom edge of the bin coming off the conveyor is engaged, and secondly, at a distance from the trough substantially equal to the height of the bins, a pair of lateral retaining fins for retaining the bin which has been tipped onto the deck about its bottom edge.

2. A device according to claim 1, wherein said fins have inwardly-directed flanges preventing the bin from sliding on the deck when tilted.

3. A device according to claim 1, including detection means for detecting a bin tipped onto said deck, said means being mounted on the deck at a distance from the trough that is shorter than the height of the bins, and being used to control an actuator member for tilting said deck.

4. A device according to claim 1, wherein said conveyor has free rollers.

5. A device according to claim 2, wherein said deck has a lateral skirt on each side, extending under said deck and moving therewith.

6. A device according to claim 2, wherein said deck is equipped with a flexible end lip fixed on the first end of said deck and overlapping the magazine.

7. A device according to claim 3, wherein a retarder is associated with said actuator member tilting said deck, to provide automatic return of said actuator member to its substantially horizontal initial position.

8. A device according to claim 6, wherein the moving lateral skirt has the shape of a sector of a circle, with a rounded edge to avoid the conveyor when the deck is tilted.

9. A device according to claim 7, further including a fixed lateral skirt associated with and partially overlying each moving lateral skirt, and cooperating therewith to provide complete coverage of the underneath of the deck.

10. A method of loading articles for loading articles from storage bins in which the articles are stacked flat onto a rear end portion of an unstacking magazine, said device comprising a conveyor substantially level with but not adjoining the rear end portion of the magazine and receiving the bins of articles, a substantially horizontal coupling deck between the conveyor and the rear end portion of the magazine, a shaft pivotally mounting a first end of the coupling deck to the rear end of the magazine for pivoting the coupling deck about said rear end of the magazine, said coupling deck including close to an opposite second end a tipping trough for tipping the bins onto the deck and having at a distance from the trough substantially equal to the height of the bins, a pair of lateral retaining fins, said method comprising the steps of:

loading said bins filled with articles onto said conveyor;

ensuring that the end portion of the unstacking magazine is free of articles over a length not less than the height of the entire stack of articles in a bin;

moving a first bin on the conveyor forwards onto said deck, until a leading bottom edge of said first bin falls into said trough;

tipping the bin over onto the deck about its leading bottom edge engaged in the trough; and retaining the stack of articles in the tipped-over bin and tilting the deck, and guiding the stack as the stack slides by gravity out of the bin and along the tilted deck; and bringing the stack into position against a stack previously loaded on the magazine.

11. A method according to claim 10, wherein the steps of moving said first bin forwards and tipping of said first bin over are performed with one hand by an operator, where the step of retaining the stack of articles is performed by the operator with another hand, and wherein the step of bringing the stack into position against said stack previously loaded on the magazine is effected by an operator using both hands.

* * * * *